US010161406B2

(12) United States Patent
Sishtla

(10) Patent No.: US 10,161,406 B2
(45) Date of Patent: Dec. 25, 2018

(54) COMPRESSOR CLEARANCE CONTROL

(75) Inventor: Vishnu M. Sishtla, Manlius, NY (US)

(73) Assignee: Carrier Corporation, Palm Beach Gardens, FL (US)

( * ) Notice: Subject to any disclaimer, the term of this patent is extended or adjusted under 35 U.S.C. 154(b) by 181 days.

(21) Appl. No.: 14/126,881

(22) PCT Filed: Jun. 11, 2012

(86) PCT No.: PCT/US2012/041848

§ 371 (c)(1),
(2), (4) Date: Dec. 17, 2013

(87) PCT Pub. No.: WO2013/012491

PCT Pub. Date: Jan. 24, 2013

(65) Prior Publication Data

US 2014/0216087 A1 Aug. 7, 2014

Related U.S. Application Data

(60) Provisional application No. 61/508,259, filed on Jul. 15, 2011.

(51) Int. Cl.
*F04D 27/00* (2006.01)
*F04D 29/058* (2006.01)
(Continued)

(52) U.S. Cl.
CPC ..... *F04D 27/002* (2013.01); *F04D 27/0246* (2013.01); *F04D 29/052* (2013.01);
(Continued)

(58) Field of Classification Search
CPC .. F04D 25/06; F04D 25/0606; F04D 25/0653; F04D 29/051; F04D 29/05;
(Continued)

(56) References Cited

U.S. PATENT DOCUMENTS 3,123,010 A * 3/1964 Witt ..... F04D 29/2266 415/106
4,076,179 A * 2/1978 Tsukube ..... B02C 18/0092 241/185.6

(Continued)

FOREIGN PATENT DOCUMENTS

CN 201090491 Y 7/2008
CN 101248316 A 8/2008

(Continued)

OTHER PUBLICATIONS

Chinese Office Action for Chinese Patent Application No. 201280035168.5, dated Jul. 3, 2015.

(Continued)

*Primary Examiner* — Patrick Hamo
*Assistant Examiner* — Joseph Herrmann
(74) *Attorney, Agent, or Firm* — Bachman & LaPointe, P.C.

(57) ABSTRACT

A compressor (22) has a housing assembly (50) with a suction port (24) and a discharge port (26). An impeller (54) is supported by a shaft (70) which is mounted for rotation to be driven in at least a first condition so as to draw fluid in through the suction port (24) and discharge the fluid from the discharge port (26). A magnetic bearing system (66, 67, 68) supports the shaft (70). A controller (84) is coupled to an axial position sensor (80) and is configured to control impeller position.

9 Claims, 4 Drawing Sheets

(51) Int. Cl.

| | |
|---|---|
| ***F25B 49/02*** | (2006.01) |
| ***F04D 27/02*** | (2006.01) |
| ***F04D 29/052*** | (2006.01) |
| ***F04D 29/16*** | (2006.01) |
| *F04D 15/00* | (2006.01) |

(52) U.S. Cl.
CPC ..... *F04D 29/058* (2013.01); *F04D 29/162* (2013.01); *F25B 49/022* (2013.01); *F04D 15/0033* (2013.01)

(58) Field of Classification Search
CPC .... F04D 29/056; F04D 29/058; F04D 29/403; F04D 29/42; F04D 29/4206; F04D 29/4213; F04D 29/4226; F04D 27/022; F04D 27/02466; F04D 15/0027; F04D 15/0033; F04D 29/622
See application file for complete search history.

(56) References Cited

U.S. PATENT DOCUMENTS

| | | | | |
|---|---|---|---|---|
| 4,091,687 | A | 5/1978 | Meinke et al. | |
| 4,820,115 | A * | 4/1989 | Bandukwalla | F04D 29/668 415/106 |
| 5,216,308 | A * | 6/1993 | Meeks | F16C 32/0459 310/90.5 |
| 5,299,909 | A * | 4/1994 | Wulf | F01D 9/045 415/186 |
| 5,310,311 | A * | 5/1994 | Andres | B64D 13/06 310/90.5 |
| 5,312,226 | A | 5/1994 | Miura et al. | |
| 5,565,722 | A | 10/1996 | Rubner et al. | |
| 5,572,079 | A * | 11/1996 | Pinkerton | F16C 32/0444 310/90.5 |
| 5,857,348 | A | 1/1999 | Conry | |
| 5,924,847 | A * | 7/1999 | Scaringe | F04D 25/06 417/42 |
| 6,320,290 | B1 * | 11/2001 | Kanebako | F16C 32/0468 310/90.5 |
| 6,463,748 | B1 | 10/2002 | Benedict et al. | |
| 6,581,399 | B2 | 6/2003 | Benedict et al. | |
| 6,591,612 | B2 * | 7/2003 | Bolz | F02B 33/40 123/565 |
| 7,322,207 | B2 | 1/2008 | Kikuchi et al. | |
| 7,694,540 | B2 | 4/2010 | Ishida et al. | |
| 7,717,684 | B2 * | 5/2010 | Sekiguchi | F04D 19/04 417/324 |
| 7,726,948 | B2 * | 6/2010 | Hunter | F01M 1/16 417/212 |
| 7,789,049 | B2 * | 9/2010 | Duley | F01P 5/12 123/41.44 |
| 7,963,748 | B2 * | 6/2011 | Taniguchi | F04D 27/001 417/18 |
| 8,104,298 | B2 * | 1/2012 | Sishtla | F04D 29/058 417/365 |
| 2002/0009361 | A1 | 1/2002 | Reichert et al. | |
| 2007/0065276 | A1 | 3/2007 | Muller et al. | |
| 2007/0065277 | A1 | 3/2007 | Muller et al. | |
| 2008/0115527 | A1 | 5/2008 | Doty et al. | |
| 2008/0292469 | A1 * | 11/2008 | Taniguchi | F04D 27/001 417/14 |
| 2009/0133431 | A1 | 5/2009 | Nakazeki et al. | |
| 2009/0260388 | A1 | 10/2009 | Nakazeki et al. | |
| 2012/0063918 | A1 * | 3/2012 | de Larminat | F16C 19/52 417/1 |
| 2014/0216087 | A1 * | 8/2014 | Sishtla | F04D 29/058 62/228.1 |

FOREIGN PATENT DOCUMENTS

| | | | |
|---|---|---|---|
| CN | 101558268 | A | 10/2009 |
| EP | 0361844 | A2 | 4/1990 |
| EP | 0550801 | A2 | 7/1993 |
| EP | 0716241 | A1 | 6/1996 |
| EP | 1775424 | A2 | 4/2007 |
| JP | 2009281213 | A | 12/2009 |
| WO | 2007/067169 | A1 | 6/2007 |

OTHER PUBLICATIONS

European Office Action for EP Patent Application No. 12727210.2, dated Apr. 16, 2014.
Chinese Office Action for CN Patent Application No. 201280035168.5, dated Feb. 22, 2016.
Catalog: "Daikin McQuay, Magnitude Frictionless Centrifugal Chiller", Model WME, Catalog 604, 2009, McQuay International, Minneapolis, see p. 21.
Edward J. Temos, Slide Presentation, "Compound Centrifugal Chillers for High Head Applications", 2003, IDEA 2003, Philadelphia, PA.
International Search Report and Written Opinion for PCT/US2012/041848, dated Nov. 28, 2012.

* cited by examiner

COMPRESSOR CLEARANCE CONTROL

CROSS-REFERENCE TO RELATED APPLICATION

Benefit is claimed of U.S. Patent Application Ser. No. 61/508,259, filed Jul. 15, 2011, and entitled "Compressor Clearance Control", the disclosure of which is incorporated by reference herein in its entirety as if set forth at length.

BACKGROUND

The disclosure relates to compressors. More particularly, the disclosure relates to electric motor-driven magnetic bearing compressors.

One particular use of electric motor-driven compressors is liquid chillers. An exemplary liquid chiller uses a hermetic centrifugal compressor. The exemplary unit comprises a standalone combination of the compressor, the cooler unit, the chiller unit, the expansion device, and various additional components.

Some compressors include a transmission intervening between the motor rotor and the impeller to drive the impeller at a faster speed than the motor. In other compressors, the impeller is directly driven by the rotor (e.g., they are on the same shaft).

Various bearing systems have been used to support compressor shafts. One particular class of compressors uses magnetic bearings (more specifically, electro-magnetic bearings). To provide radial support of a shaft, a pair of radial magnetic bearings may be used. Each of these may be backed up by a mechanical bearing (a so-called "touch-down" bearing). Additionally, one or more other magnetic bearings may be configured to resist loads that draw the shaft upstream (and, also, opposite loads). Upstream movement tightens the clearance between the impeller and its shroud and, thereby, risks damage. Opposite movement opens clearance and reduces efficiency.

Magnetic bearings use position sensors for adjusting the associated magnetic fields to maintain radial and axial positioning against the associated radial and axial static loads of a given operating condition and further control synchronous vibrations.

SUMMARY

Accordingly, one aspect of the disclosure involves a compressor having a housing assembly with a suction port and a discharge port. An impeller is supported by a shaft which is mounted for rotation to be driven in at least a first condition so as to draw fluid in through the suction port and discharge the fluid from the discharge port. A magnetic bearing system supports the shaft. A controller is coupled to an axial position sensor and is configured to control impeller position to vary with at least one of system capacity and lift.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
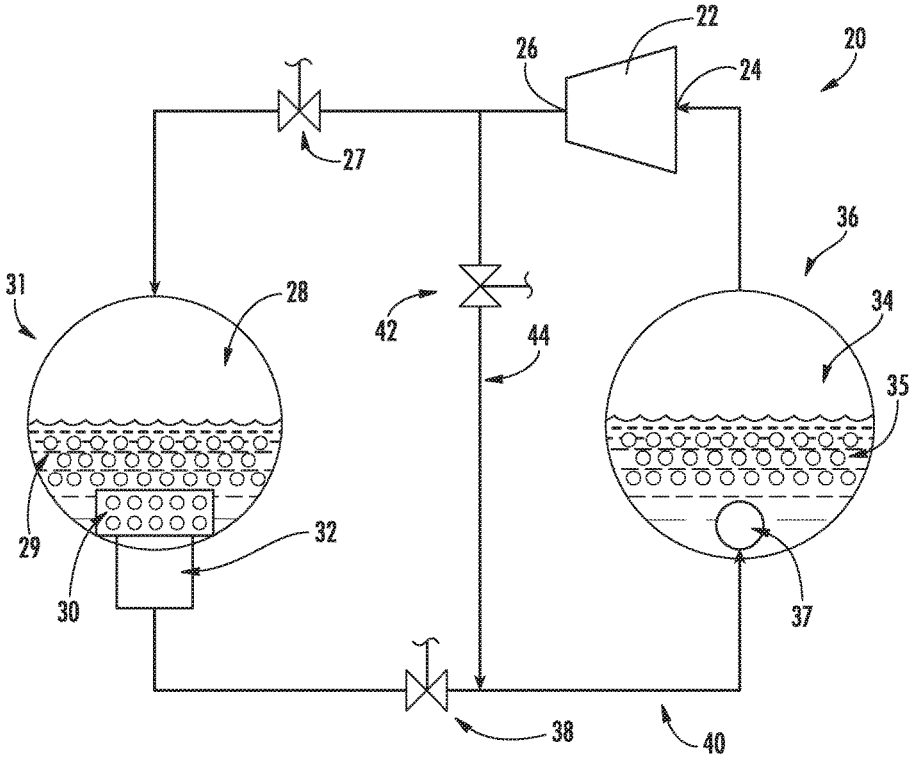
FIG. 1 (PRIOR ART)
FIG. 1 is a partially schematic view of a chiller system.

FIG. 1 shows a vapor compression system 20. The exemplary vapor compression system 20 is a chiller system. The system 20 includes a centrifugal compressor 22 having a suction port (inlet) 24 and a discharge port (outlet) 26. The system further includes a first heat exchanger 28 in a normal operating mode being a heat rejection heat exchanger (e.g., a gas cooler or condenser). In an exemplary system based upon an existing chiller, the heat exchanger 28 is a refrigerant-water heat exchanger formed by tube bundles 29, 30 in a condenser unit 31 where the refrigerant is cooled by an external water flow. A float valve 32 controls flow through the condenser outlet from a subcooler chamber surrounding the subcooler bundle 30.

The system further includes a second heat exchanger 34 (in the normal mode a heat absorption heat exchanger or evaporator). In the exemplary system, the heat exchanger 34 is a refrigerant-water heat exchanger formed by a tube bundle 35 for chilling a chilled water flow within a chiller unit 36. The unit 36 includes a refrigerant distributor 37. An expansion device 38 is downstream of the compressor and upstream of the evaporator along the normal mode refrigerant flowpath 40 (the flowpath being partially surrounded by associated piping, etc.).

A hot gas bypass valve 42 is positioned along a bypass flowpath branch 44 extending between a first location downstream of the compressor outlet 26 and upstream of the isolation valve 27 and a second location upstream of the inlet of the cooler and downstream of the expansion device 38.

The compressor (FIG. 2) has a housing assembly (housing) 50. The exemplary housing assembly contains an electric motor 52 and an impeller 54 drivable by the electric motor in the first mode to compress fluid (refrigerant) to draw fluid (refrigerant) in through the suction port 24, compress the fluid, and discharge the fluid from the discharge port 26. The exemplary impeller is directly driven by the motor (i.e., without an intervening transmission).

The housing defines a motor compartment 60 containing a stator 62 of the motor within the compartment. A rotor 64 of the motor is partially within the stator and is mounted for rotation about a rotor axis 500. The exemplary mounting is via one or more electromagnetic bearing systems 66, 67, 68 mounting a shaft 70 of the rotor to the housing assembly. The exemplary impeller 54 is mounted to the shaft (e.g., to an end portion 72) to rotate therewith as a unit about an axis 500.

Figure 2:
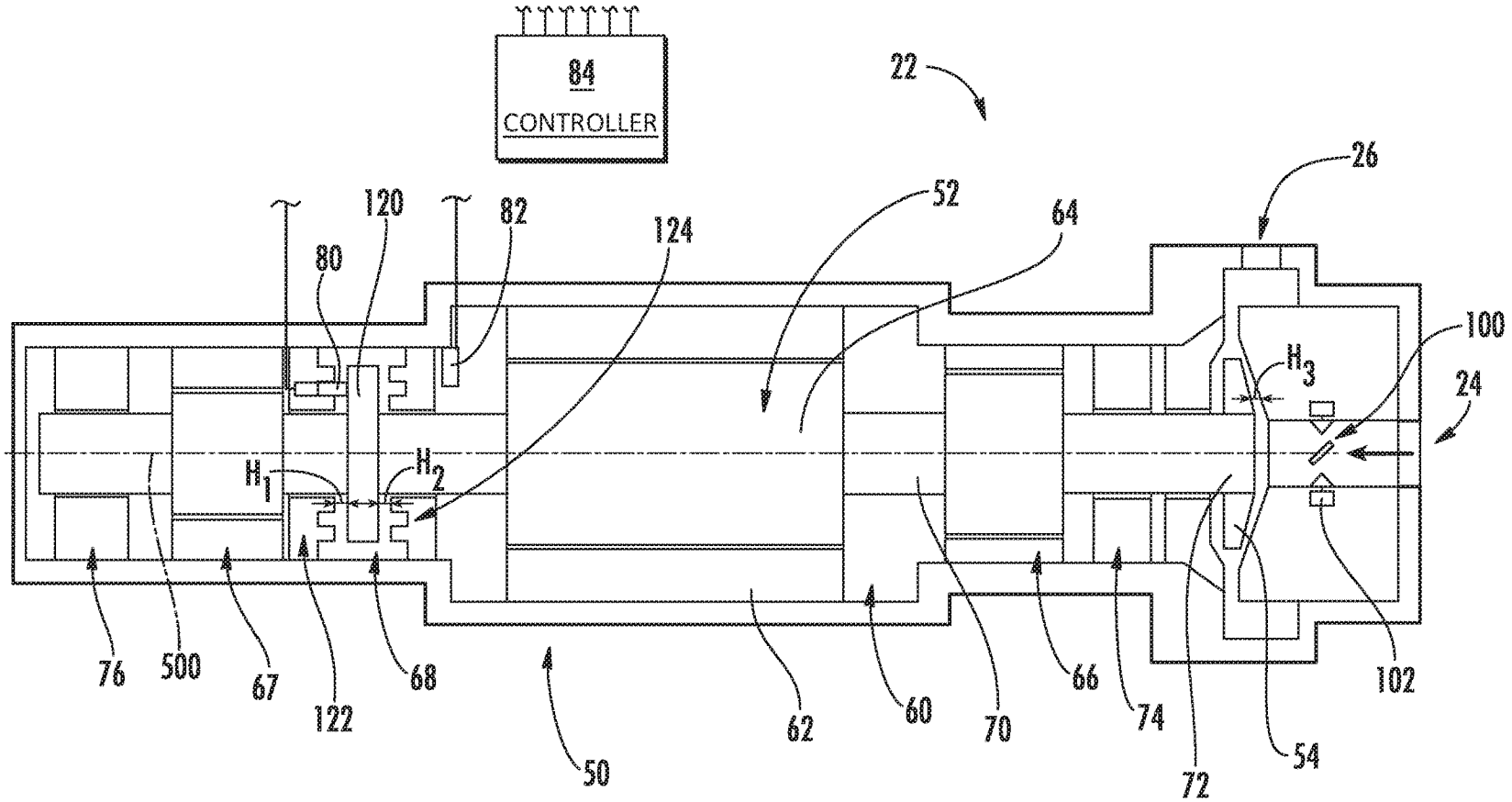
FIG. 2 (PRIOR ART)
FIG. 2 is a longitudinal sectional view of a compressor of the chiller system.

The exemplary bearing system 66 is a radial bearing and mounts an intermediate portion of the shaft (i.e., between the impeller and the motor) to the housing assembly. The exemplary bearing system 67 is also a radial bearing and mounts an opposite portion of the shaft to the housing assembly. The exemplary bearing 68 is a thrust/counterthrust bearing. The radial bearings radially retain the shaft while the thrust/counterthrust bearing has respective portions axially retaining the shaft against thrust and counterthrust displacement. FIG. 2 further shows an axial position sensor 80 and a radial position sensor 82. These may be coupled to a controller 84 which also controls the motor, the powering of the bearings, and other compressor and system component functions. The controller may receive user inputs from an input device (e.g., switches, keyboard, or the like) and additional sensors (not shown). The controller may be coupled to the controllable system components (e.g., valves, the bearings, the compressor motor, vane 100 actuators 102 and the like) via control lines (e.g., hardwired or wireless communication paths). The controller may include one or more: processors; memory (e.g., for storing program information for execution by the processor to perform the operational methods and for storing data used or generated by the program(s)); and hardware interface devices (e.g., ports) for interfacing with input/output devices and controllable system components.

The assignment of thrust versus counterthrust directions is somewhat arbitrary. For purposes of description, the counterthrust bearing is identified as resisting the upstream movement of the impeller caused by its cooperation with the fluid. The thrust bearing resists opposite movement. The exemplary thrust/counterthrust bearing is an attractive bearing (working via magnetic attraction rather than magnetic repulsion). The bearing 68 has a thrust collar 120 rigidly mounted to the shaft 72. Mounted to the housing on opposite sides of the thrust collar are a counterthrust coil unit 122 and a thrust coil unit 124 whose electromagnetic forces act on the thrust collar. There are gaps of respective heights $H_1$ and $H_2$ between the coil units 122 and 124 and the thrust collar 120.

FIG. 2 further shows mechanical bearings 74 and 76 respectively serving as radial touchdown bearings so as to provide a mechanical backup to the magnetic radial bearings 66 and 67, respectively. The inner race has a shoulder that acts as an axial touchdown bearing.

As so far described, the system and compressor may be representative of any of numerous system and compressor configurations. The sensors 80 and 82 may be existing sensors used for control of the electromagnetic bearings. In an exemplary modification from a baseline such system and compressor, the control routines of the controller 84 may be augmented with an additional routine or module which uses the outputs of one or both of the sensors 80 and 82 to optimize a running clearance $H_3$. The hardware may otherwise be preserved relative to the baseline.

In centrifugal compressors using open type impellers, running clearance between impeller and shroud is a key characteristic that influences compressor efficiency. Reducing clearance will improve efficiency.

The actual instantaneous clearance (running clearance) may be difficult to directly measure. Measured axial position of the impeller at the bearing system (e.g., at the thrust collar) may act as a proxy for a non-running clearance (cold clearance). The running clearance will reflect cold clearance combined with impeller and/or shaft deformation/deflection (e.g., deformations/deflections due to operational forces) and the like.

In an exemplary baseline compressor, a cold clearance is set during assembly to ensure that adequate running clearance will be provided across the intended range of operation. During assembly, the axial range or movement of the shaft as limited by the touchdown bearing is adjusted (e.g., via rotor shimming) to be within certain range. For example, in an exemplary 500-1000 cooling ton (1750-3500 kW) compressor, an exemplary range is 0.002-0.020 inch (0.05-0.5 mm) (of cold clearance as determined by the mechanical touchdown bearings). The baseline control algorithm seeks to maintain a nominal cold clearance within that range.

It may be desired, however, to vary cold clearance during operation. It may be desired to change the cold clearance while the compressor is running to optimize performance (e.g., maximize efficiency) and/or maximize capacity.

It may be desirable to have a smaller cold clearance at part load than at full load. In such a situation, running clearance may be similar across the load range. If cold clearance were set for adequate running clearance at max load, then there would be relatively large running clearance at part/low load. The clearance is associated with a leakage flow between impeller and shroud which represents a loss. At low load, the larger running clearance causes a disproportionately large loss and therefore efficiency reduction. Reducing cold clearance at low loads to a level that still ensures adequate running clearance can at least partially reduce the relative efficiency loss associated with the leakage.

Controlling rotor position or the associated cold clearance to reduce running clearance also has benefit in increasing the maximum available flow through the compressor. The flow through the compressor is the flow through the impeller minus leakage flow through the clearance (an internal recirculation). The maximum flow through the impeller is related to impeller geometry. Accordingly, reducing running clearance decreases the leakage flow and increases the maximum available flow through the compressor. This effect may increase capacity at a given operational condition (given pressure difference).

The magnetic thrust bearing is designed to carry the axial load within the above range. This is done by varying the magnetic field on either side (a thrust side and a counterthrust side) of the bearing. Estimated required clearance at various loads is loaded into controls software. The capacity can be determined either from inlet guide vane position or measurement of evaporator water flow rate and state points (pressure and temperature).

Another way of setting the position of impeller dynamically or adaptively is by measuring the power for several positions at a given operating condition and selecting the one that gives the minimum power.

An exemplary magnetic bearing works on the principle of attraction: the higher the field current, the more the attractive force. Thus an attractive magnetic thrust bearing may be located axially opposite a mechanical thrust bearing (e.g. a mechanical bearing serving as a back-up to the magnetic bearing. With attractive bearings and the bearings exerting a net force in a direction away from the suction port, the coil unit 122 may be powered at a higher voltage than the unit 124. The unit 122 is thus designated as the "active side" whereas the opposite unit 124 would be the "inactive side". The impeller is subjected to axial thrust due to gas forces which moves the impeller toward the shroud and closes the gap. By adjusting the current to the thrust side and the counter thrust side, the gap can be adjusted to the required position.

The particular relationship between the applied current or voltage and the associated force is dictated by the magnetic circuit design. An exemplary magnetic circuit consists of an iron lamination and an air gap inductance. The relationship between current and force may be determined by analytical and experimental analysis. The relationship may be expressed by an exemplary equation:

$$F = \frac{\mu_0 A_p N^2 i^2}{h^2}$$

Where $\mu_0$ is the permeability, $A_p$ is the pole face area, N are the number of turns of copper wire and i is the current and h is the gap between thrust collar and stationary magnetic bearing. By varying the current on active side and/or inactive side, the net magnetic force and hence the position of the impeller can be changed (by the same increment or by differing amounts).

If the respective currents through the units 122 and 124 are $i_1$ and $i_2$, to reduce clearance, $i_1$ is reduced and/or $i_2$ increased. The sensor (not shown) on the front or of the impeller will determine the clearance.

An exemplary controller may be pre-programmed with a map of target cold clearance (e.g., as an actual distance or a corresponding voltage output value of the position sensor) vs. operating capacity (%). As an alternative, some compressor controllers may be pre-programmed to work with multiple configurations of compressor. One example involves a compressor series wherein different models (or submodels) within the series have differing impeller blade height, but are otherwise similar. The controller may be programmed with a map of a clearance ratio (ratio of the aforementioned cold clearance to blade height) vs. operating capacity.

When assembling such a compressor, an impeller code corresponding to the blade height may be entered. The controller may have a corresponding map such as:

| Impeller code | Blade height at impeller outlet (inches (mm)) |
|---|---|
| 1 | 0.5 (13) |
| 2 | 0.6 (15) |
| 3 | 0.7 (18) |
| 4 | 0.8 (20) |

An exemplary map of target cold clearance ratio vs. capacity is:

| Capacity (%) | Cold Clearance Ratio |
|---|---|
| 100 | 0.03 |
| 75 | 0.025 |
| 50 | 0.02 |
| 25 | 0.018 |

In this example, over a range of operation including the 25-100% capacity range, the target cold clearance will increase with capacity increase. The exemplary clearance target increase from 25-100% capacity is two-thirds (0.3-0.18)/0.18). More broadly, the exemplary increase is at least one third or at least 50% or at least two-thirds.

An exemplary map of voltage values vs. cold clearance for eddy current sensors are 200 millivolt/0.001 inch (7.9 millivolt/micrometer).

| Cold Clearance (inch (mm)) | Voltage (V) |
|---|---|
| 0.01 (0.25) | 2.0 |
| 0.02 (0.51) | 4.0 |
| 0.03 (0.76) | 6.0 |
| 0.04 (1.0) | 8.0 |

Figure 3:
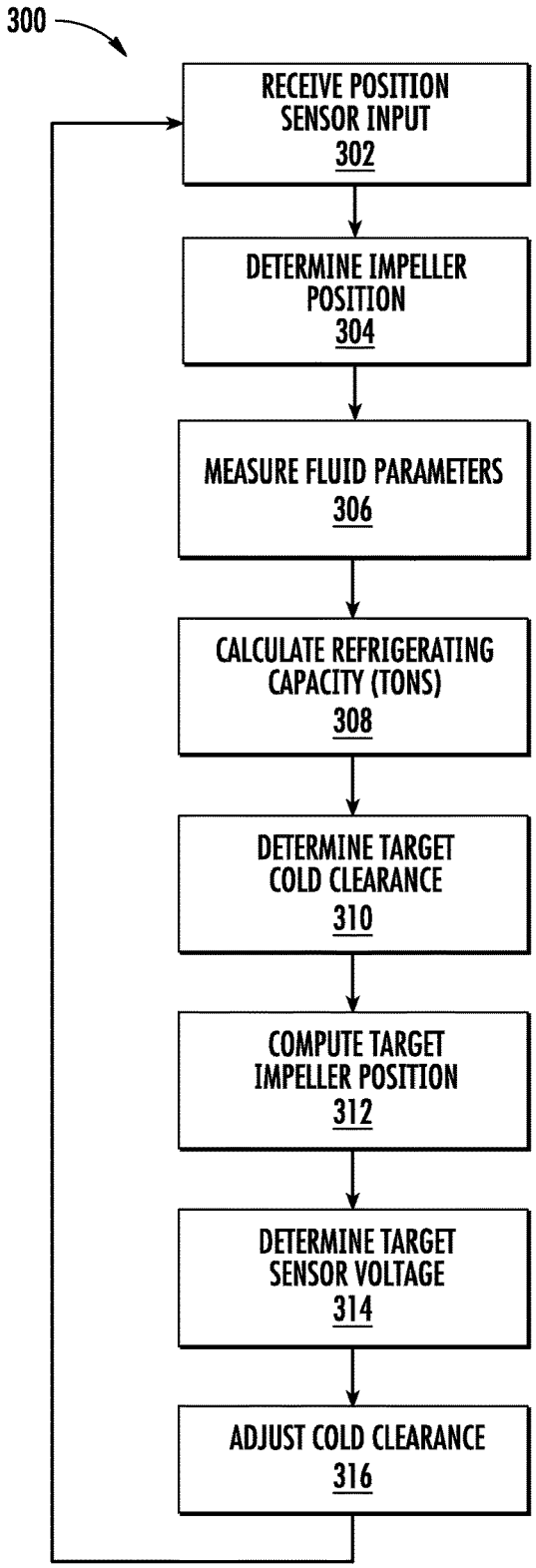
FIG. 3 is a first control flowchart.

FIG. 3 is an exemplary control flowchart of a control process 300. This exemplary routine may be added to the existing control routine (e.g., of a baseline compressor). The process includes receiving position sensor input 302. Impeller position (thus cold clearance) is then determined 304 (e.g., from the lookup table mentioned above or by programmed functional relation). Fluid parameters are then measured. 306 Exemplary parameters include the cooler water flow rate, inlet temperature, and outlet temperature from associated sensors. Refrigerating capacity is then calculated 308 based on those measured parameters.

A target clearance for the determined capacity is then determined 310 (e.g., from the lookup table above). A target impeller position corresponding to the target cold clearance is then determined 312 (e.g., via subtracting a known calibration amount determined at setup/assembly). A target sensor voltage corresponding to the target impeller position is then determined 314 (e.g., from the same lookup table or function used in step 304 but reversed).

Cold clearance may then be adjusted 316. In one example, the adjustment is based upon the difference between the target position and the actual position of the impeller (e.g., based upon the difference $deltaV_{SENSOR}$ between the target sensor voltage determined in step 314 and the sensor voltage measured in step 302 and). In the example of a position sensor in the table above, voltage increases with clearance. An alternatively configured sensor could operate in the reverse of this. If $deltaV_{SENSOR}$ is positive (the target sensor voltage determined in step 314 is greater than the actual sensor voltage from step 302), then cold clearance will be reduced; if $deltaV_{SENSOR}$ is negative, cold clearance will be increased. The exemplary clearance increase or decrease involves reducing current to one side of the bearing and increasing current to the other side as discussed above. The exemplary reduction and increase are by an amount $KdeltaV_{SENSOR}$ where K is a constant chosen experimentally to be of sufficiently high magnitude to provide a timely correction, but not so high as to risk overcorrection resonances. More complex change algorithms are possible. An exemplary cold clearance change between 25% and 100% capacity is at least 0.005 inch (0.13 mm), more narrowly 0.005-0.015 inch (0.13-0.38 mm) or 0.006-0.01 inch (0.15-0.25 mm).

Figure 4:
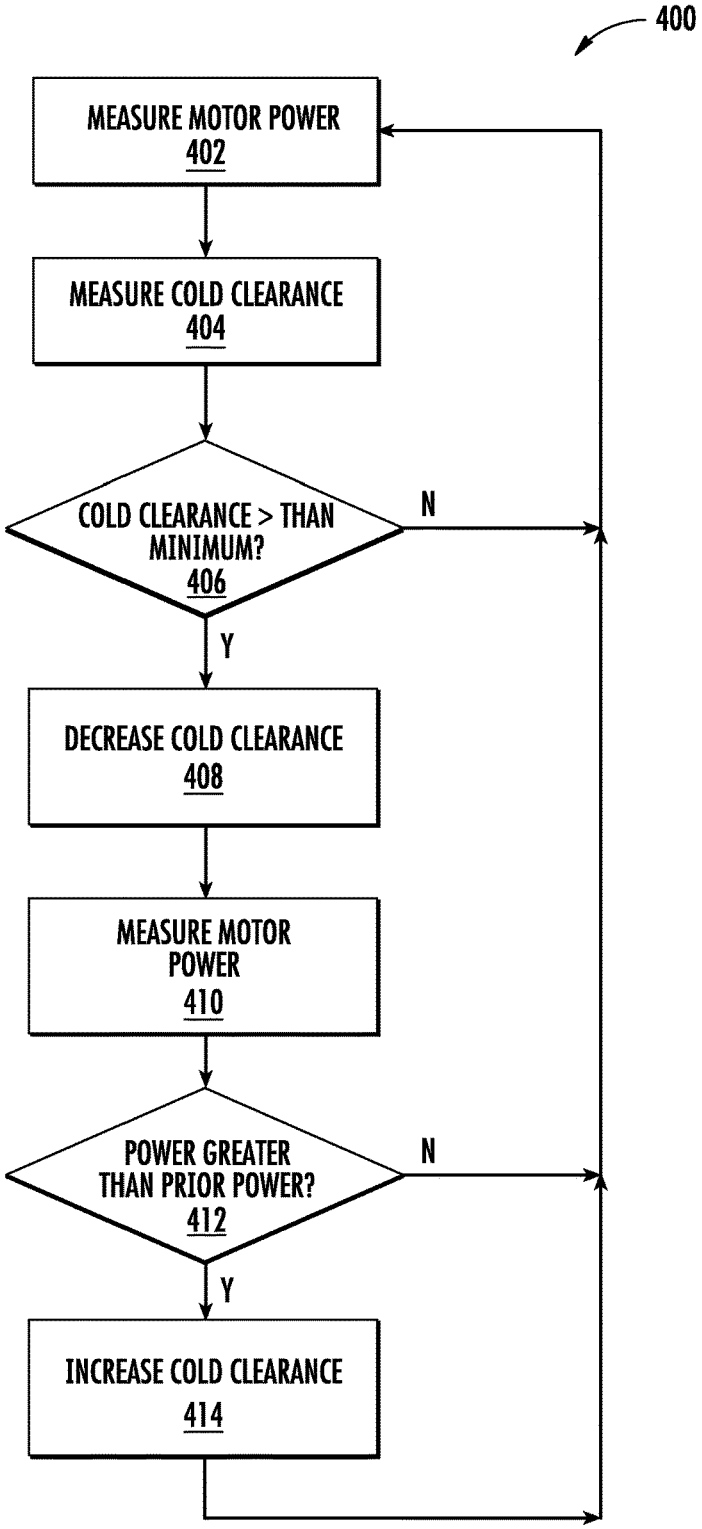
FIG. 4 is a second control flowchart.

FIG. 4 shows a dynamic (on-the-fly) control algorithm 400 for power consumption minimization. Motor power is measured 402. Cold clearance is measured 404 (e.g., via the position sensor as described above). Measured cold clearance is compared 406 to a minimum acceptable cold clearance. The exemplary minimum acceptable clearance is condition-dependent. The minimum acceptable cold clearance may be determined via a formula or a look-up table. An exemplary look-up table involves the cold clearance (or other position proxy) versus a lift or saturation temperature difference:

| Lift (F(C)) | Minimum Cold Clearance (inches (mm)) |
|---|---|
| 70 (39) | 0.004 (0.10) |
| 60 (33) | 0.006 (0.15) |
| 50 (28) | 0.008 (0.20) |
| 40 (22) | 0.01 (0.25) |

The exemplary look up table is minimum cold clearance as a function of lift (condenser saturation temperature minus cooler saturation temperature) for a given impeller code. Thus, there may be separate tables for each impeller code, or a single table with a further conversion factor or function reflecting impeller code.

Thus, the comparison 406 may receive inputs from steps for measuring and/or calculating the latter parameters. If the measured cold clearance is greater than the minimum acceptable cold clearance for the operational condition, then cold clearance is decreased 408. Exemplary decrease is via a pre-determined linear increment (e.g., 0.02 inch (0.05 mm)) which may be effected by current changes on opposite sides of the bearing. The current changes associated with the pre-determined linear increment will vary with condition. The current change may be calculated by the controller based upon present position and current values in view of the formula above.

Motor power is re-measured 410 and compared 412 to the previously-measured power. If power has increased, then the controller increases 414 cold clearance. The controller may increase the cold clearance by a predetermined increment such as the same increment used at step 408. If power has decreased, then the process repeats.

Although an embodiment is described above in detail, such description is not intended for limiting the scope of the present disclosure. It will be understood that various modifications may be made without departing from the spirit and scope of the disclosure. For example, when applied to the reengineering of an existing compressor or a compressor in an existing application, details of the existing compressor or application may influence details of any particular implementation. Accordingly, other embodiments are within the scope of the following claims.

What is claimed is:

1. A vapor compression system comprising:

a compressor (22) comprising:

a housing assembly (50) having a suction port (24) and a discharge port (26);

an impeller (54), the impeller being an open-type impeller;

a shaft (70) supporting the impeller to be driven in at least a first operating condition so as to draw fluid in through the suction port and discharge said fluid out from the discharge port;

a magnetic bearing system (66, 67, 68) supporting the shaft;

an axial position sensor (80); and a controller (84) coupled to the axial position sensor and configured to control impeller axial position to vary with at least one of system capacity and lift;

wherein the fluid is refrigerant;

a first heat exchanger (28) coupled to the discharge port to receive the refrigerant driven in a downstream direction in the first operating condition of the compressor;

an expansion device (32) downstream of the first heat exchanger; and a second heat exchanger (30) downstream of the expansion device and coupled to the suction port to return the refrigerant in the first operating condition.

2. The vapor compression system of claim 1 wherein:

the housing assembly further comprises a motor compartment (60);

an electric motor (52) has a stator (62) within the motor compartment and a rotor (64) within the stator, the rotor being mounted fur rotation about a rotor axis (500); and the shaft couples the impeller (54) to the rotor.

3. The vapor compression system of claim 1 wherein the magnetic bearing system comprises:

a first radial bearing (66);

a second radial bearing (67); and a thrust bearing (68).

4. The vapor compression system of claim 3 wherein:

the thrust bearing is a thrust/counterthrust bearing.

5. The compressor of claim 1 wherein the controller is also programmed to:

control the magnetic bearing system to limit synchronous vibration.

6. The vapor compression system of claim 1 wherein the controller is programmed to control the impeller axial position to vary with the system capacity so as to improve efficiency.

7. The vapor compression system of claim 1 wherein:

the compressor is a single-impeller compressor; and the impeller is a single-stage impeller.

8. A vapor compression system comprising:

a compressor (22) comprising:

a housing assembly (50) having a suction port (24) and a discharge port (26);

an impeller (54), the impeller being an open-type impeller;

a shaft (70) supporting the impeller to be driven in at least a first operating condition so as to draw fluid in through the suction port and discharge said fluid out from the discharge port;

a magnetic bearing system (66, 67, 68) supporting the shaft;

an axial position sensor (80); and a controller (84) coupled to the axial position sensor and to the magnetic bearing system and configured control the magnetic bearing system so as to control impeller axial position to vary with at least one of system capacity and lift;

wherein the fluid is refrigerant;

a first heat exchanger (28) coupled to the discharge port to receive the refrigerant driven in a downstream direction in the first operating condition of the compressor;

an expansion device (32) downstream of the first heat exchanger; and a second heat exchanger (30) downstream of the expansion device and coupled to the suction port to return the refrigerant in the first operating condition.

9. The system of claim 8 wherein:

the axial position sensor is positioned to measure an axial position of a thrust collar of the magnetic bearing system; and the controller is configured so as to control the impeller axial position to vary with said at least one of system capacity and lift by controlling said axial position of said thrust collar of the magnetic bearing system to vary with said at least one of system capacity and lift based on a target varying with said at least one of system capacity and lift.

* * * * *